United States Patent [19]

Gueret

[11] Patent Number: 4,850,727

[45] Date of Patent: Jul. 25, 1989

[54] MAKE-UP RESERVOIR APPLICATOR SEAL

[75] Inventor: Jean-Louis H. Gueret, Paris, France

[73] Assignee: L'Oreal, Paris, France

[21] Appl. No.: 85,259

[22] Filed: Aug. 12, 1987

Related U.S. Application Data

[63] Continuation of Ser. No. 821,326, Jan. 22, 1986, abandoned, which is a continuation of Ser. No. 458,117, Jan. 14, 1983, abandoned, which is a continuation of Ser. No. 279,324, Jul. 1, 1981, abandoned.

[30] Foreign Application Priority Data

Jul. 9, 1980 [FR] France ..... 80 15257

[51] Int. Cl.[4] ..... A45D 40/26

[52] U.S. Cl. ..... 401/126; 401/122; 401/129; 401/130

[58] Field of Search ..... 401/122, 128, 129, 130, 401/267, 126

[56] References Cited

U.S. PATENT DOCUMENTS

| | | | |
|---|---|---|---|
| 223,531 | 1/1880 | Newton | 401/130 |
| 371,133 | 10/1887 | Fisher | 401/267 X |
| 575,380 | 1/1897 | Shackleton | 401/129 X |
| 3,415,604 | 12/1968 | Ahrens et al. | 401/122 |
| 3,614,247 | 10/1971 | Otsuka | 401/199 |
| 3,651,990 | 3/1972 | Cernei | 401/128 X |
| 3,861,810 | 1/1975 | Vasas | 401/122 |
| 3,891,330 | 6/1975 | Vasas | 401/122 |
| 3,957,066 | 5/1976 | Dahm | 401/122 X |

FOREIGN PATENT DOCUMENTS

| | | | |
|---|---|---|---|
| 122447 | 10/1943 | Australia | 401/128 |
| 2301 | 6/1979 | European Pat. Off. | 401/122 |
| 1418477 | 10/1965 | France | 401/129 |
| 2339319 | 9/1977 | France | 401/122 |
| 2390917 | 12/1978 | France . | |
| 2412287 | 7/1979 | France . | |
| 344925 | 4/1960 | Switzerland . | |
| 471782 | 9/1937 | United Kingdom . | |
| 504954 | 5/1939 | United Kingdom . | |
| 1215762 | 3/1968 | United Kingdom . | |
| 1276859 | 6/1969 | United Kingdom . | |

*Primary Examiner*—Steven A. Bratlie
*Attorney, Agent, or Firm*—Cushman, Darby & Cushman

[57] ABSTRACT

A make-up applicator unit comprises a reservoir for liquid make-up product and an applicator carried by the cap of the reservoir. The seal between the applicator and the reservoir, when the cap is screwed home, is formed by a sealing member which is separate from the applicator and is free to rotate so that when the applicator rotates in contact with the sealing element during the final stages of screwing the cap onto the reservoir the applicator is not subjected to excessive torsional strain.

6 Claims, 2 Drawing Sheets

MAKE-UP RESERVOIR APPLICATOR SEAL

This application is a continuation of Ser. No. 06/821,326, filed Jan. 22, 1986, now abandoned, which is a continuation of Ser. No. 06/458,117, filed Jan. 14, 1983, now abandoned, which is a continuation of Ser. No. 06/279,324, filed July 1, 1981, now abandoned.

The present invention concerns a make-up unit comprising a reservoir for a make-up product and an applicator provided with a flexible, elastically deformable end fitting allowing the make-up product to be applied. The abovementioned make-up end fitting may, for instance, take the shape of a spatula made of soft rubber; or of a small brush whose bristles are carried by a deformable mounting for applying make-up to the eyelashes; or of a felt tip; or of a brush also comprising a deformable mounting; or of a soft rubber pen used for eye make-up.

A make-up unit of this kind is described in French Pat. No. 2,412,287. It comprises a reservoir, containing a coloured liquid for use as "eye-liner", and having a threaded collar on which the cap of the associated applicator can be screwed. The threaded neck of the reservoir is extended towards the bottom of the reservoir via an inner glove finger at the bottom of which is an opening through which the make-up pen of the applicator can pass. The make-up pen in question is in the form of a cone ending in a pointed tip; a transverse cavity cut in the abovementioned cone serves as holder for a reserve supply of the coloured liquid which holder feeds at least one capillary channel ending in the tip of the pen. Each time the applicator pen is dipped into the associated reservoir, the abovementioned cavity fills with coloured liquid in a sufficient quantity to ensure a complete make-up for the eyes. The make-up pen is carried by a rod projecting in relation to the applicator cap and is fixed to the latter.

In the above French Patent, the make-up pen is advantageously made of soft rubber so as to produce a sensation of softness on the skin when the make-up is applied and to avoid any risk of irritation or lesion of the skin. Near its connecting zone with the rod supporting it, it is provided with an annular shoulder abutting the edge of the opening of the reservoir arranged at the bottom of the glove finger when the applicator is screwed on to the reservoir. The abovementioned annular shoulder thus makes a seal when the applicator pen closes the reservoir opening. However, it will be observed that the annular shoulder, made of the same material as the soft rubber pen, does not have the hardness required to obtain a good seal. It is, of course, possible to increase the hardness of the annular shoulder and thus obtain a good seal by choosing a more rigid material, for example a conventional thermoplastic elastomer, but then the make-up pen no longer has the required softness. Moreover, the application of the annular shoulder of the pen on the rim of the reservoir opening is effected by screwing the applicator cap on to the threaded neck of the reservoir. If this application of the shoulder on the rim occurs before the applicator is screwed home and if the user continues to screw up the pen, the rubber pen which is immobilised on the rim of the opening is then subjected to considerable torsion strain which may damage it irretrievably.

The object of the present invention is, in particular, to remedy the abovementioned two-fold drawback and for this purpose, it is proposed to make a make-up unit wherein the make-up pen on the one hand, and the element producing the seal of the pen in the reservoir opening on the other hand, constitute two separate pieces. Thus, the sealing element may be made of a material having the required hardness for sealing and the make-up pen may be made of a soft rubber material having the required softness for the application of the make-up product. The annular sealing element may be carried either by the rim of the opening, or by the pen within a groove provided for this purpose, In this latter case, provision will advantageously be made for the pen to be capable of turning within the annular sealing element so that any complementary screwing action taking place after the sealing element abuts the rim of the opening should not entail any torsion, and consequently deterioration of the pen made of a soft relatively fragile material is avoided.

In the prior art make-up unit, the tail end of the soft rubber pen was disposed within the rigid hollow stem of the applicator and the mechanical connection between these two components was obtained by crimping, that is to say, by a local flattening of the rigid stem wall around the tail of the soft rubber pen. Such a mechanical connection was not only inconvenient to make, but was also sometimes unsatisfactory. In a variant of the invention, the sealing element is produced by moulding with a sleeve within which the pen tail is pre-stressed and the sleeve is force-fitted within the rigid hollow stem. This embodiment makes it possible to resolve two problems simultaneously: that of achieving the seal by means of a sealing element of the required hardness and that of fixing the soft pen without a rigid stem.

Thus the present invention provides a make-up dispenser-applicator unit comprising a reservoir for a make-up product; and a make-up applicator provided with a soft elastically deformable end fitting for applying the make-up product in the reservoir to a skin surface; wherein the applicator penetrates into the reservoir through an opening and is removably fixed on the reservoir to close off said opening wherein the seal between the opening of the reservoir and the part of the applicator which penetrates into the opening is ensured by means of an annular sealing element formed separately from the make-up end fitting, and wherein said annular element is made of a material which is harder than the soft elastically deformable material of which the make-up end fitting is formed.

It is preferable for the make-up end fitting to consist of a pen for tracing make-up lines on the eyelids (known herein as an eye-liner pen). The make-up pen advantageously comprises a part of a substantially conical shape ending in a tip, an oblong transverse cavity being formed in the conical part of the pen, and the said cavity communicating with at least one capillary channel emerging at the tip of the pen.

In a preferred embodiment, the annular sealing element is made of a substantially rigid plastic material; the detachable fixing of the applicator within the associated reservoir is effected by screwing a cap of the applicator on to the threaded neck of the reservoir; the threaded neck of the reservoir is extended towards the bottom of the said reservoir by means of an inner sleeve, the opening of the reservoir which is intended to be sealed by the applicator being formed in the bottom of the abovementioned sleeve; the applicator comprises a stem projecting relative to the cap, the make-up end fitting being carried by that one of the stem ends which is not connected to the cap.

In a first advantageous embodiment of the make-up unit according to the invention, the annular sealing element is arranged within a peripheral groove around the make-up end fitting between the projecting part of the said end fitting and its tail which is inserted inside the hollow applicator stem. In this case, the annular sealing element and the peripheral groove accommodating it are dimensioned so that the end fitting may turn within the annular element when the annular element abuts the reservoir opening during screwing of the applicator on to the reservoir. As a variant the annular sealing element forms the peripheral end flange of a collar arranged within a groove around the tail of the make-up end fitting, the abovementioned tail being pre-stressed within the collar and the sleeve being force-fitted within the rigid hollow applicator stem.

In a second advantageous embodiment of the unit according to the invention, the annular sealing element, instead of being carried by the make-up end fitting, is rotatably carried by the rim of the reservoir opening which is intended to be closed and sealed by the applicator. For this purpose, the annular sealing element comprises a peripheral outer groove within which the rim of the abovementioned reservoir opening is snap-engaged; in this case, the annular sealing element is intended to cooperate with the end of the rigid stem carrying the make-up end fitting.

In a third advantageous embodiment of the make-up unit according to the invention, the solid applicator stem is terminated at a projecting head which is snap-engaged within a complementary housing in the make-up end fitting; the abovementioned head is connected to the solid applicator stem by means of a peripheral groove receiving on the one hand the rim of the opening of the housing in which the projecting head of the stem is snap-engaged, and on the other hand the annular sealing element intended to abut the rim of the reservoir opening. The projecting stem head is rotatably received within the recess in the make-up end fitting and this also makes it possible to prevent any torsion of the end fitting when the annular sealing element abuts the rim of the reservoir opening and the user continues to screw home the applicator on the threaded neck of the reservoir.

In order that the present invention may more readily be understood, there will be described below several embodiments illustrated in the accompanying drawings by way of purely illustrative and non-restrictive examples. In these drawings.

Figure 2:
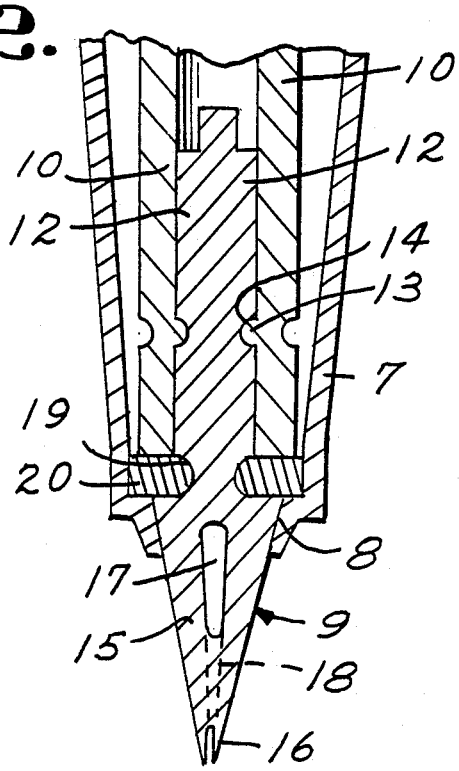
FIG. 2 is a detail on an enlarged scale of the stoppering zone of the make-up unit of FIG. 1.
Figure 1:
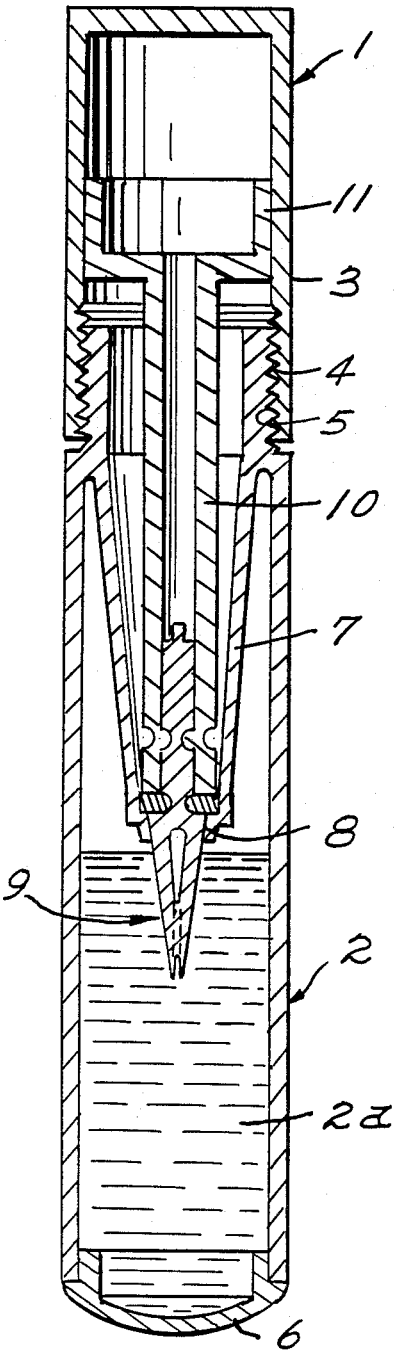
FIG. 1 is an axial cross section of a first embodiment of the make-up unit according to the invention, wherein the annular sealing element is carried by the make-up end fitting.

Referring to FIGS. 1 and 2 of the drawing, there will be seen a make-up unit 1 used for tracing make-up lines on the eyelids and around the eyes.

This unit 1 is in the form of a cylindrical stick whose lower part is constituted by a reservoir 2 and whose upper part is formed by a cylindrical cap 3 forming part of the applicator associated with the reservoir. Cap 3 is able to be screwed on reservoir 2 by means of an inner thread 4 which cooperates with an external thread provided on a collar 5 of the reservoir 2. Reservoir 2 contains a coloured liquid 2*a*, in this case "eye-liner". The threaded collar 5 is extended downwardly into the reservoir 2 by a tapering sleeve 7. The bottom of sleeve 7 is pierced by a circular opening 8 which is sealingly closed by the applicator when the cap 3 of the applicator is screwed on to the reservoir 2.

Apart from the cap 3, the applicator further comprises a hollow stem 8 and, as the make-up end fitting, a pen 9. The hollow stem 8 is arranged along the axis of cap 3 and projects relative thereto; it is connected at one of its ends to a larger diameter sleeve 11 fixed, for example by bonding, to the inside of cap 3.

The make-up pen 9 has a structure approximating to that which is described in French Pat. No. 2,412,287; it is made of a soft, elastically deformable rubber material. The tail end 12 of pen 11 is engaged within a hollow stem 10 of the applicator; it is fixed within the hollow stem by a local pinching of the rigid stem wall at 13 within an annular groove 14 provided on end 12 of the pen. The projecting part 15 of the make-up pen has a substantially conical configuration and terminates in a pointed tip 16. Along approximately the larger diameter half of the abovementioned cone is an axially extending oblong cavity 17 (FIG. 2). Two identical capillary channels 18 opening out into the oblong cavity 17 are diametrically opposed to each other; the width of the channels progressively contracts from the oblong cavity 17 towards the pen tip 16. In the zone of tip 16, the two channels meet up to give rise to a small space delimited by the two sides constituting the tip.

When the pen 9 is lowered into the make-up liquid 2*a* contained in the reservoir 2, the oblong cavity 17 as well as the two capillary channels 28 become charged with the make-up liquid. When the applicator is then separated from the associated reservoir 2, the oblong cavity 17 remains charged with the make-up liquid. Make-up lines can then be traced by moving the pen 9 of the applicator over the surface to be made up. During this movement the make-up liquid flows out along the two capillary channels 18 (FIG. 2) to the end of the pen tip 16 and these channels are permanently recharged with the make-up liquid, thanks to the reservoir formed by the oblong cavity 17.

A peripheral groove 19 is formed around the make-up pen 9 between the projecting conical part 15 and the tail end 12. Within this groove 19 is a sealing element 20 forming, in relation to the pen 9, an annular shoulder intended to abut the rim of the circular opening 8 of reservoir 2. The annular sealing element 20 is so dimensioned in relation to the groove 19 accommodating it that pen 9 is capable of turning in relation to the sealing element 20. In this way, when the applicator is screwed on to reservoir 2, the pen 9 may turn within the annular element 20 without any risk of being damaged by shear or by torsion. The material constituting the annular sealing element 20 can be chosen to have a hardness appropriate to ensuring a good seal between the rim of the opening and the applicator, when the applicator is in the screwed in position on the reservoir. On the other hand, the make-up pen 9 can be made of a soft rubber material much less hard than the sealing element 20, not only to avoid any risk of a skin lesion but also to ensure a comfortable make-up action.

Figure 3:
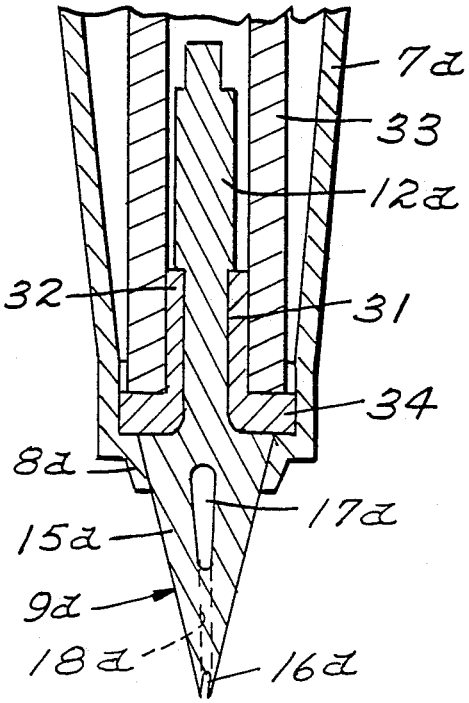
FIG. 3 is a detail, similar to that of FIG. 2, showing a variant wherein the sealing element is integral with a sleeve.

FIG. 3 shows a variant of the above described embodiment, with a different manner of connecting the soft rubber make-up pen with the hollow applicator stem 33. The make-up pen of FIG. 3 has been designated as 9*a;* it has a configuration approximating to that of the make-up pen of FIG. 2; and it comprises a conical projecting part 15*a* having a transversely extending oblong cavity 17*a* forming the reservoir. The abovementioned cavity 17*a* communicates with two diametrically opposed capillary channels 18*a* whose width contracts progressively from the oblong cavity 17*a* towards the pointed tip 16*a* of the pen.

On the tail end 12*a* of the pen, which is inserted into the hollow stem 33, is a groove 31 which accommodates a collar 32 made of a material harder than the soft rubber of the pen 9*a*. Collar 32 terminates on the side of the projecting part 15*a* of the pen by a larger diameter peripheral flange 34 intended to come to abut the rim of the opening 8*a* of the reservoir to ensure the leak-proof closure of the said opening. As before, the substantially rigid material constituting the roller 32 and its flange 34, has the hardness required for obtaining a good seal.

The tail end 12*a* of the make-up pen 9*a* is pre-stressed within the collar 32 and the sleeve is itself force-fitted within the hollow stem 33. Such a mechanical connection ensures an effective fixing of the soft rubber pen 9*a* within the rigid hollow stem 33. Thus the presence of the collar 32 makes it possible to solve a two-fold problem simultaneously: namely that of the seal, thanks to the presence of the peripheral flange 34 having an appropriate hardness, and also that of fixing the soft pen 9*a* within a rigid hollow stem 33.

Figure 4:
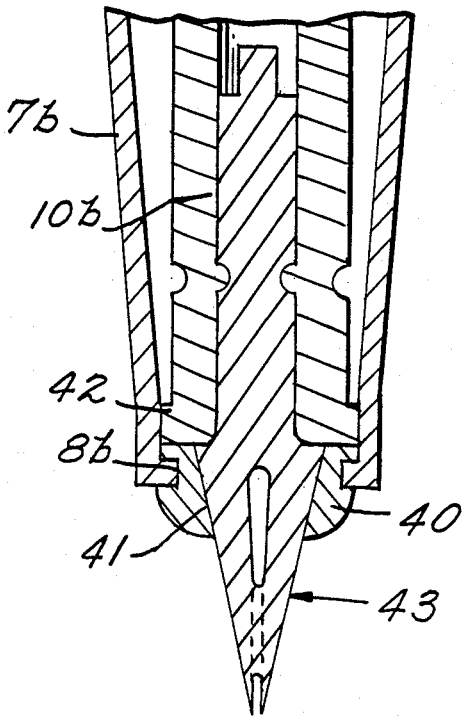
FIG. 4 is a detail similar to those of FIGS. 2 and 3, showing a second embodiment of the make-up unit according to the invention wherein the sealing element is carried by the rim of the reservoir opening.

In the make-up unit of FIGS. 1 and 2, the leak proof closure of the reservoir opening 8 by the applicator is ensured by a separate component 20 which is rotatably carried by the make-up pen 9. In the embodiment of FIG. 4, the annular sealing element 40 is carried by the rim of the opening 8*b* of the reservoir. It comprises, for this purpose, a peripheral channel 41 within which the rim of opening 8*b* is snap-engaged. When the applicator is screwed on to the associated reservoir, the peripheral rim 42 of the hollow stem 10*b* abuts the annular sealing element 40 to stop up opening 8*b* in a leak proof manner. As before, the annular sealing element 40 is made of a material having the required hardness for sealing; on the other hand, the make-up pen 43, which has a structure which is similar to that of FIG. 2, is made of a rubber which is sufficiently soft to facilitate an agreeable make-up action without the risk of skin lesions or abrasions.

Figure 5:
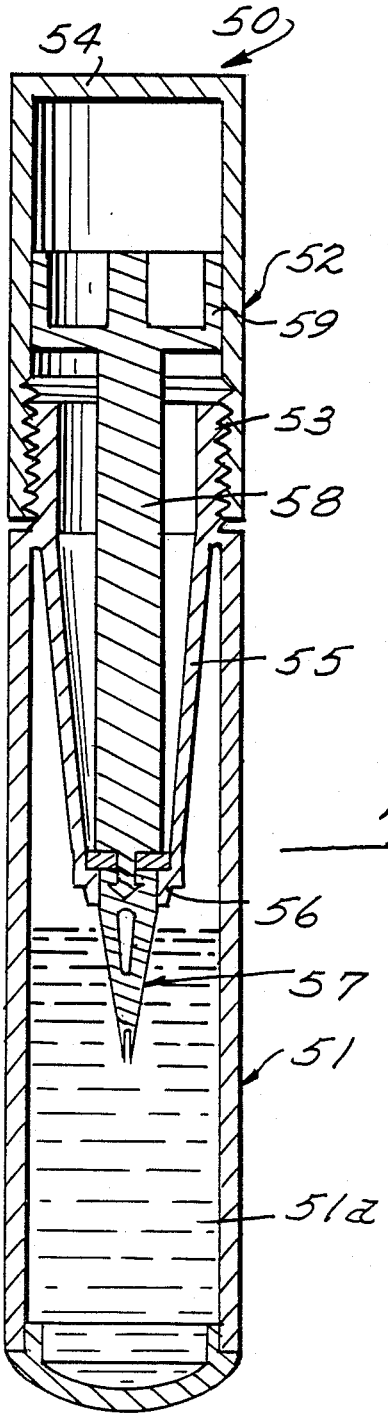
FIG. 5 is an axial cross section of a third embodiment of the make-up unit according to the invention, wherein the sealing element is carried by the applicator stem.
Figure 6:
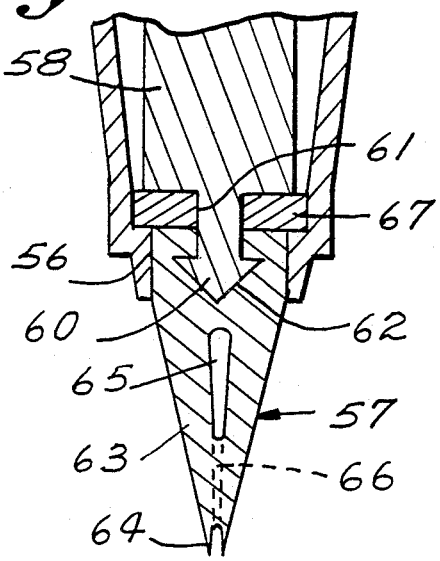
FIG. 6 is a detail on an enlarged scale of the stoppering zone of the make-up unit of FIG. 5.

Referring to FIGS. 5 and 6 of the drawing, there will be seen a make-up unit which is used to trace make-up lines on the eyelids and around the eyes. This unit, designated by 50 as a whole, is approximately analogous to that described above in relation to FIGS. 1 and 2. It results from associating the applicator 52 with a cylindrical reservoir 51 containing a make-up liquid 51*a*. The cylindrical reservoir 51 is provided with a threaded neck 53 around which the cap 54 of the applicator 52 can be screwed. The threaded neck 53 is extended towards the zone 51*a* of reservoir 51 by a flexible sleeve 55 at the bottom of which is a circular opening 56. The make-up pen 57 of the applicator penetrates into the abovementioned opening when the applicator is screwed on to the reservoir 51. The make-up pen 57 is carried by one of the ends of a solid stem 58 disposed coaxially of the cap 54 and is continued within the cap to a sleeve 59; the sleeve is fixed, for instance by bonding, to the inside of a cap 54 of the applicator.

The solid applicator stem 58 terminates, at its end adjacent the pen 57, in a head 60 (see also FIG. 6) of an approximately conical shape, the tip of the cone facing away from the connecting zone with stem 58. In the connecting zone between stem 58 and the conical head 60, is a groove 61. Head 60 is snap-engaged within a complementary axial recess 62 of pen 57. The opening of the axial recess 62 has a diameter which is substantially equal to that of groove 61 of the solid stem 58, the head 60 of the solid stem 58 being located within the housing 62 of the pen 57 by force fitting due to the deformation of the soft rubber material of which the pen 57 is made.

The pen 57 comprises a substantially cylindrical part within which are the housing 62 and a conical part 63 which is continued into the abovementioned cylindrical part and ends in a pointed tip 64. The conical part 63 of the pen includes the transversely extending oblong cavity 65 communicating at its two ends with two diametrically opposed capillary channels 66; the width of the two capillary channels 66 increases progressively from the oblong cavity 65 up to tip 64 where they combine to give rise to a small space delimited by the two sides constituted by the tip 64.

As in the above described embodiments of make-up pen the cavity 65 constitutes a reservoir for a make-up liquid; when the tip 64 is displaced over the surface to be made up, the make-up liquid will flow out on to tip 64 via the two capillary channels 66, these channels being fed from the make-up liquid held by the oblong cavity 65.

Around the groove 61, there engages an annular sealing element 67 which abuts the rim of the opening 56 of the reservoir when the applicator 52 is screwed on to the neck 53 of the reservoir 51*a*. The annular sealing element 67 is made of a conventional thermoplastic elastomer having a hardness which is optimum for producing a good seal. The pen 57 is made of a soft rubber facilitating a pleasant and comfortable make-up section, without the risk of irritation or abrasion of the skin. Conical head 60 is mounted within the housing 62 of the pen so as to be able to pivot in relation to the pen; it follows that even if, while screwing the applicator on to the reservoir, the soft rubber pen 57 comes to be immobilised by the rim of opening 56, the head 60 of the applicator may then turn within the pen, which avoids any torsion or shear of the pen.

It should be understood that the embodiments described above are in no way restrictive and may give rise to any desirable modifications, without thereby departing from the scope of the invention as defined by the claims. In particular, provision may be made for other make-up applicators, instead of the make-up pens 9, 9*a*, 43, 57. For example the make-up applicator may be a spatula made of natural or synthetic rubber, or a small brush whose bristles are carried by a deformable mounting for the application of make-up to the eyelashes, or a felt tip or a pencil brush also comprising a deformable mounting for the application of eye-shadow to the eyelids.

I claim:

1. A make-up dispenser-applicator unit comprising a reservoir for a liquid make-up; a make-up applicator means including an end element formed of a soft elastically deformable material for applying the make-up product in the reservoir to a skin surface; means defining an opening into the reservoir for receiving said applicator means, said opening having a rim; means removably attaching said applicator means to the reservoir to close off said opening; and seal means establishing a seal between said opening of the reservoir and the applicator means adjacent said end element upon penetration of said applicator means into the opening; wherein said seal means comprise an annular sealing element formed separately from said make-up end element, said annular element being made of a material which is harder than the soft elastically deformable material of which the end element of the make-up applicator means is formed, said annular sealing element having a flange and an outwardly open peripheral groove formed therein, said rim of said opening being disposed spaced from said applicator means to define an annular space therebetween, said annular element being mounted to said rim of the opening so that said rim is disposed in said peripheral groove of said annular sealing element and said annular sealing element is disposed in said annular space, said annular sealing element being rotatably disposed relative to at least one of said reservoir and said applicator means; said applicator means including a rigid stem having hollow receiving means and said end element having a tail end inserted into said receiving means and a tip which is spaced from said hollow receiving means, said annular sealing element sealingly contacting said rigid stem adjacent a distal end of ssaid hollow receiving means so as to establish said seal between said opening and said applicator means, said unit having a neck, said reservoir having a bottom and said opening into said reservoir comprising a tapering, elongated wall which extends from said neck to said rim in the direction of said bottom; said applicator means being shaped to fit in said opening to said reservoir.

2. A unit according to claim 1, wherein said annular sealing element is made of a substantially rigid plastic material.

3. A unit according to claim 1, wherein said reservoir includes a neck supporting said applicator means and a removable cap to close the reservoir; wherein said cap carries said applicator means; and wherein said means removably attaching said applicator means to the associated reservoir comprise co-operating screw thread means on said cap and said neck.

4. A unit according to any one of claims 1, 2, or 3, wherein said end element includes a recess having a rim and said stem includes a projecting head snap-engaged within said recess.

5. A unit according to any one of claim 2 or 3, wherein the make-up end fitting comprises of a pen for tracing lines of make-up on the eyelids.

6. A make-up dispenser-applicator unit comprising a reservoir for a liquid make-up product; a make-up applicator means including a stem and an end element carried by said stem and formed of a soft elastically deformable material for applying the make-up product in the reservoir to a skin surface; means defining an applicator receiving portion extending into the reservoir and terminating in an opening for providing access to a liquid make-up product within said reservoir, said opening having a rim, said unit having a neck, said reservoir having a bottom and said applicator receiving portion comprising a tapering, elongated wall which extends from said neck to said opening in the direction of said bottom, said applicator means being shaped to fit in said applicator receiving portion; means removably attaching said applicator means to the reservoir to close off said applicator receiving portion; and seal means establishing a seal between said opening and the applicator means adjacent a distal end of said applicator means upon penetrating the opening; wherein said seal means comprise an annular sealing element formed separately from said make-up end element, said annular element being made of a material which is harder than the soft elastically deformable material of which the end element of the make-up applicator means is formed, said annular sealing element having a flange and an outwardly open peripheral groove formed therein with said rim of said opening being disposed spaced from said stem to define an annular space, said flange being received in said annular space and said rim being disposed in said peripheral groove of said annular sealing element whereby said annular sealing element is rotatably disposed relative to at least one of said reservoir and said applicator means and being supported against said rim of said opening; said seal means being located adjacent said end element and providing said seal between the stem of said applicator means and said opening.

* * * * *